US008910718B2

(12) United States Patent
Watson et al.

(10) Patent No.: US 8,910,718 B2
(45) Date of Patent: Dec. 16, 2014

(54) SYSTEM AND METHOD FOR A COMBINED SUBMERSIBLE MOTOR AND PROTECTOR

(75) Inventors: Arthur I. Watson, Sugar Land, TX (US); Steven Dornak, Damon, TX (US); Michael W. Miller, Bartlesville, OK (US); Parveen Sayela, Toronto (CA); Cody Casey, Lawrence, KS (US); Gregory H. Manke, Overland Park, KS (US); Mark McCorry, Aberdeen (GB); John D. Rowatt, Bartlesville, OK (US); Mark E. Allen, Bartlesville, OK (US); Diego A. Narvaez, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1501 days.

(21) Appl. No.: 10/711,631

(22) Filed: Sep. 29, 2004

(65) Prior Publication Data

US 2005/0109515 A1 May 26, 2005

Related U.S. Application Data

(60) Provisional application No. 60/507,929, filed on Oct. 1, 2003.

(51) Int. Cl.
*E21B 43/12* (2006.01)

(52) U.S. Cl.
CPC ..... *E21B 43/128* (2013.01)
USPC ..... 166/378; 166/66.4; 166/105; 310/71; 310/87; 417/423.3; 439/191

(58) Field of Classification Search
USPC ..... 166/66.4, 105.1, 105.3, 111, 369, 378, 166/381; 417/414, 423.3, 423.7, 423.12, 417/424.2; 384/92, 97, 280, 281, 907; 310/71, 87; 439/191, 192, 193, 194
See application file for complete search history.

(56) References Cited

U.S. PATENT DOCUMENTS

| | | | | |
|---|---|---|---|---|
| 2,600,321 | A * | 6/1952 | Pyle | 524/406 |
| 2,674,194 | A | 4/1954 | Arutunoff | |
| 3,827,143 | A | 8/1974 | Johnsen et al. | |
| 3,969,092 | A | 7/1976 | Huffman et al. | |
| 4,341,534 | A | 7/1982 | Burger | |
| 4,513,215 | A * | 4/1985 | Del Serra | 310/90 |
| 4,521,708 | A * | 6/1985 | Vandevier | 310/87 |
| 4,667,737 | A * | 5/1987 | Shaw et al. | 166/104 |
| 4,696,684 | A | 9/1987 | Shen | |
| 4,854,886 | A * | 8/1989 | Neuroth | 439/192 |
| 4,992,689 | A * | 2/1991 | Bookout | 310/87 |
| 5,003,210 | A * | 3/1991 | Liu et al. | 310/87 |
| 5,051,103 | A * | 9/1991 | Neuroth | 439/192 |
| 5,367,214 | A * | 11/1994 | Turner, Jr. | 310/87 |
| 5,404,061 | A | 4/1995 | Parmeter | |

(Continued)

FOREIGN PATENT DOCUMENTS

| | | | |
|---|---|---|---|
| JP | 2001/059490 | A | 3/2001 |
| RU | 2046508 | C1 | 10/1995 |

(Continued)

*Primary Examiner* — Shane Bomar
(74) *Attorney, Agent, or Firm* — Michael Stonebrook

(57) ABSTRACT

A system and method is provided for producing a hydrocarbon fluid from a subterranean environment. The system and method utilize an electric submersible pumping system having a motive unit comprising a combined submersible motor section and protector section.

23 Claims, 12 Drawing Sheets

(56) References Cited

U.S. PATENT DOCUMENTS

| | | | | |
|---|---|---|---|---|
| 5,645,438 | A * | 7/1997 | Cairns | 439/139 |
| 5,766,517 | A | 6/1998 | Goedde et al. | |
| 5,992,517 | A * | 11/1999 | McAnally | 166/105 |
| 6,046,521 | A | 4/2000 | Heinig | |
| 6,079,206 | A | 6/2000 | Petrzik et al. | |
| 6,091,175 | A * | 7/2000 | Kinsinger | 310/90 |
| 6,100,616 | A | 8/2000 | Heinig et al. | |
| 6,126,416 | A * | 10/2000 | Lee | 417/423.3 |
| 6,140,725 | A | 10/2000 | Jensen et al. | |
| 6,179,392 | B1 | 1/2001 | Baechle et al. | |
| 6,201,327 | B1 | 3/2001 | Rivas | |
| 6,268,672 | B1 | 7/2001 | Straub et al. | |
| 6,290,430 | B1 * | 9/2001 | Scarsdale | 405/53 |
| 6,307,290 | B1 * | 10/2001 | Scarsdale | 310/87 |
| 6,379,127 | B1 | 4/2002 | Andrews et al. | |
| 6,394,220 | B1 * | 5/2002 | Kurokawa et al. | 180/444 |
| 6,398,521 | B1 * | 6/2002 | Yorulmazoglu | 417/360 |
| 6,402,810 | B1 | 6/2002 | Mayer et al. | |
| 6,595,295 | B1 * | 7/2003 | Berry et al. | 166/369 |
| 6,602,059 | B1 * | 8/2003 | Howell et al. | 417/423.3 |
| 6,679,336 | B2 * | 1/2004 | Musselwhite et al. | 166/386 |
| 6,854,556 | B1 * | 2/2005 | Yamamoto et al. | 180/444 |
| 6,868,912 | B2 * | 3/2005 | Proctor | 166/378 |
| 6,889,420 | B2 * | 5/2005 | Jones | 29/596 |
| 2002/0125777 | A1 * | 9/2002 | Parmeter et al. | 310/90 |
| 2002/0179305 | A1 * | 12/2002 | Mack et al. | 166/377 |
| 2003/0132003 | A1 | 7/2003 | Arauz et al. | |
| 2003/0156947 | A1 | 8/2003 | Gross | |
| 2004/0146415 | A1 * | 7/2004 | Merrill et al. | 417/414 |
| 2004/0159442 | A1 * | 8/2004 | Proctor | 166/378 |
| 2004/0251019 | A1 * | 12/2004 | Howell | 166/105.5 |
| 2005/0087343 | A1 * | 4/2005 | Du et al. | 166/369 |
| 2005/0269885 | A1 * | 12/2005 | Knox et al. | 310/87 |
| 2007/0046115 | A1 * | 3/2007 | Tetzlaff et al. | 310/71 |
| 2007/0051510 | A1 * | 3/2007 | Veneruso et al. | 166/244.1 |
| 2007/0074872 | A1 * | 4/2007 | Du et al. | 166/369 |

FOREIGN PATENT DOCUMENTS

| | | | |
|---|---|---|---|
| RU | 2162272 | C1 | 1/2001 |
| RU | 2177088 | C1 | 12/2001 |
| RU | 2190786 | C2 | 10/2002 |

* cited by examiner

SYSTEM AND METHOD FOR A COMBINED SUBMERSIBLE MOTOR AND PROTECTOR

CROSS-REFERENCE TO RELATED APPLICATIONS

The following is based on and claims priority to Provisional Application Ser. No. 60/507,929, filed Oct. 1, 2003.

BACKGROUND

In a variety of subterranean environments, such as wellbore environments, submersible electric pumping systems are used in the production of hydrocarbon based fluids. The submersible electric pumping systems comprise a submersible pump driven by a submersible motor which is sealed from the surrounding well fluid by a separate motor protector. The separate motor protector also compensates for thermal expansion of motor oil within the submersible motor during, for example, movement into a wellbore and/or operation of the system.

The individual submersible pumping system components, e.g. the submersible motor and motor protector, are delivered to a well site as separate components. These separate components are then assembled before they are moved downhole into the wellbore. The submersible motor and motor protector have mating flanges held together by a plurality of bolts. However, the use of separate components leads to inefficiencies in the manufacture and installation of the submersible pumping system.

SUMMARY

In general, the present invention provides a system and methodology for utilizing an integrated motive unit in a submersible pumping system. The motive unit comprises a submersible motor section and protector section combined as a single device.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for producing hydrocarbon based fluids from subterranean locations. The system and method are utilized in an electric submersible pumping system having a submersible motor and motor protector combined as a single device. In one embodiment, an electric motor section is combined with a protector mechanism such as a protector bag and/or a protector labyrinth compensation chamber. Such combination can be used, for example, to eliminate dual parts and to eliminate re-filling of the unit with oil in the field. However, the devices and methods of the present invention are not limited to use in the specific applications that are described herein.

Figure 1:
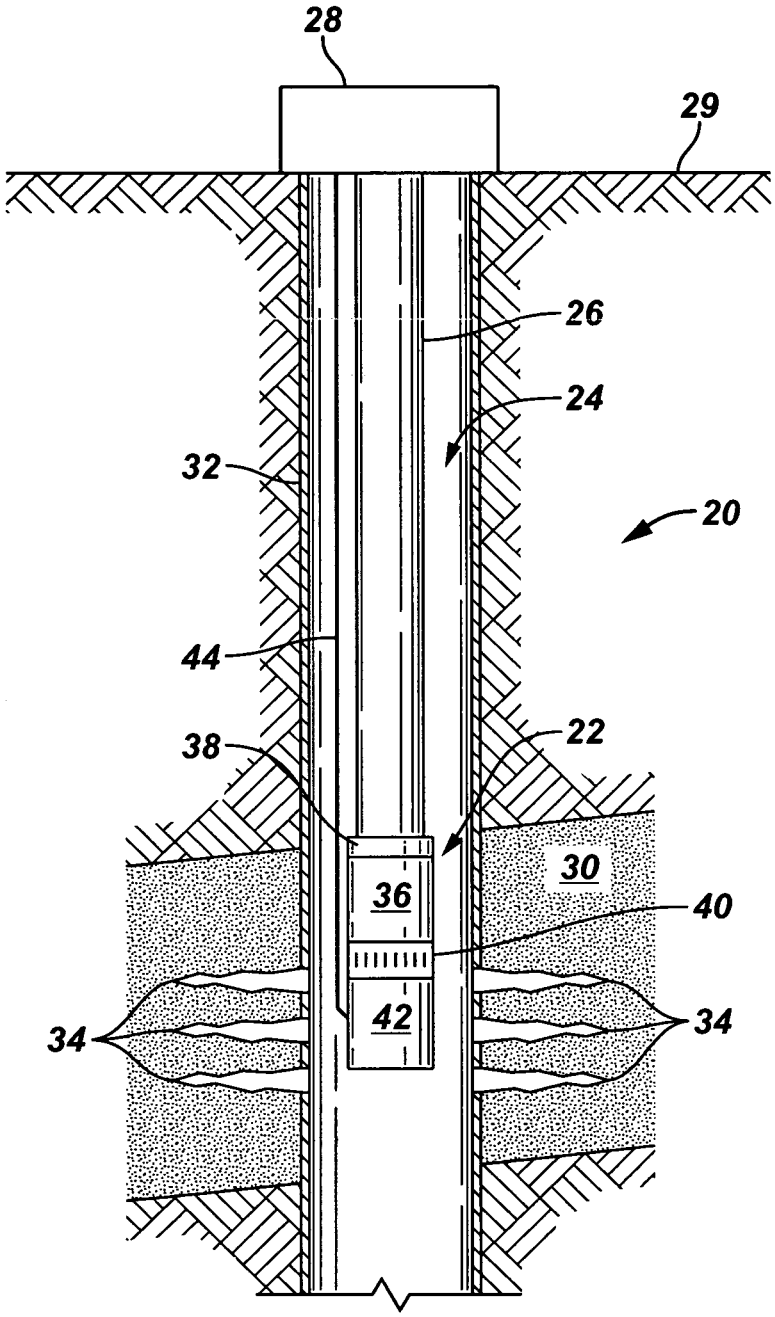
FIG. 1 is a front elevation view of an electric submersible pumping system disposed in a wellbore, according to an embodiment of the present invention.

Referring generally to FIG. 1, a system 20 is illustrated according to an embodiment of the present invention. The system 20 comprises an electric submersible pumping system 22 deployable in a subterranean environment, such as an oil production well.

In the embodiment illustrated, electric submersible pumping system 22 is deployed in a wellbore 24 by a deployment system 26, such as production tubing or coiled tubing. However, other types of deployment systems, e.g. cable deployment systems, can be used. Specifically, pumping system 22 is suspended from a wellhead 28 by deployment system 26, and a hydrocarbon based fluid is produced upwardly to wellhead 28 through the production tubing that constitutes deployment system 26. Wellhead 28 is disposed at a surface location, such as at a surface 29 of the earth.

In the illustrated example, wellbore 24 is drilled into a formation 30 holding, for example, oil. The wellbore may be lined with a casing 32 having perforations 34 through which oil flows from formation 30 into wellbore 24. It should be noted, however, that system 20 can be utilized in other applications, such as injection applications where fluid is injected into formation 30.

Electric submersible pumping system 22 comprises a submersible pump 36 coupled to deployment system 26 by a connector 38. Fluid is drawn into submersible pump 36 through a pump intake 40. Submersible pump 36 is powered by a motive unit 42 which receives electrical power via a power cable 44. As discussed below, motive unit 42 is a single device that combines a motor section with a motor protector section able to equalize pressure between the wellbore 24 and the interior of the motor section while accommodating expansion/contraction of a lubricating fluid, e.g. motor oil, within motive unit 42.

Combining the submersible motor and motor protector in a single device can save costs by eliminating parts and simplifying field installation. Additionally, the combined motive unit 42 can be prefilled with motor oil. By eliminating the need to combine a separate motor and motor protector, the motive unit can be accurately prefilled at a factory with no oil loss in the field due to assembly of separate components. Thus, time is saved and the costs are reduced during installation of electric submersible pumping system 22 in wellbore 24.

Figure 2:
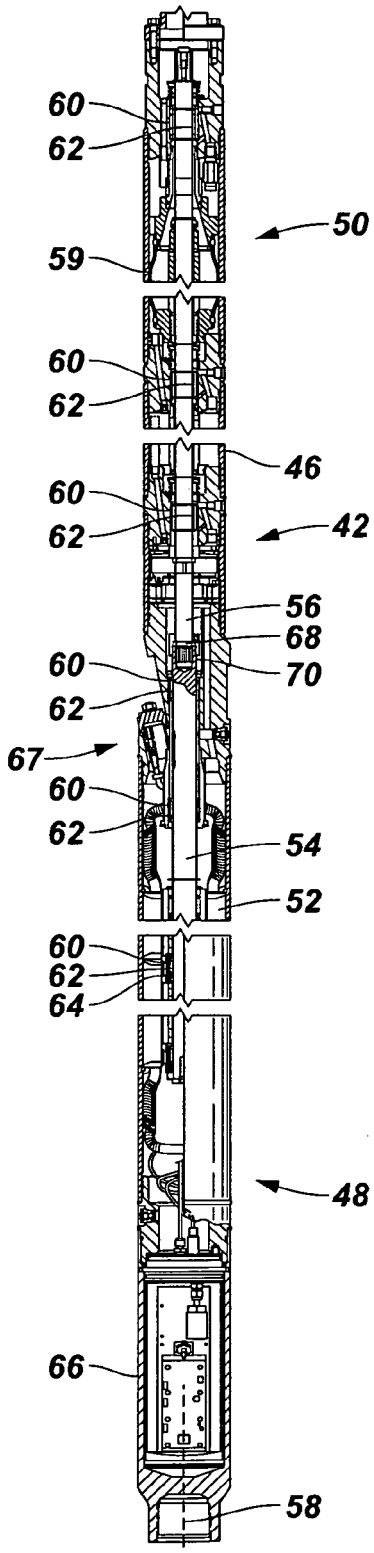
FIG. 2 is a cross-sectional view taken generally along an axis of the motive unit, according to an embodiment of the present invention.

Referring to FIG. 2, an embodiment of motive unit 42 is illustrated. Motive unit 42 comprises an outer housing 46 that houses a motor section 48 and a motor protector section 50. Motor section 48 comprises, for example, a rotor and stator section 52 and a shaft section 54 rotated thereby. Shaft section 54 is rotatably and axially affixed to a shaft section 56 of protector section 50. Shaft sections 54 and 56 rotate together about an axis 58 of motive unit 42. The protector section 50 comprises a separation and compensation chamber that may be created in a variety of forms. For example, a separation and compensation chamber 59 may be formed as one or more labyrinth or bag compensation chambers. Chamber 59 is utilized to separate wellbore fluid from motor fluid while allowing the expansion/contraction of the motor oil.

Shaft sections 54 and 56 are rotatably mounted within outer housing 46 via a plurality of journal bearings 60 having wear sleeves 62. Other types of bearings also may be utilized in motive unit 42. For example, a rotor bearing 64 may be utilized in motor section 48. Motive unit 42 also may comprise other components. For example, a sensor 66 may be integrally mounted in motor section 48. In the embodiment illustrated, sensor 66 comprises a multi-sensor that may be used to sense one or more wellbore related parameters. Electrical power is provided to motor section 48 via power cable 44 coupled to an electrical cable connection 67.

Shaft section 54 and shaft section 56 can be formed as a common shaft extending through motor section 48 and motor protector section 50. The shaft sections also may be axially affixed by welding a corrosion resistant shaft section 56 to a steel motor shaft section 54. Corrosion resistance is beneficial, because shaft section 56 may be exposed to well fluid, and therefore a corrosion resistant alloy, e.g. Monel®, Inconel®, or stainless steel, can be used to form shaft section 56. In FIG. 2, the welding of shaft sections is illustrated by a weld 68, shown in phantom lines. In another embodiment, shaft section 54 and shaft section 56 are joined permanently by fitting and end of one shaft section into an open end of the other and axially affixing the sections via, for example, an interference fit, soldering or brazing. By way of example, FIG. 2 illustrates an open end 70, such as a coupling sleeve, for receiving the adjacent shaft section end.

Figure 3:
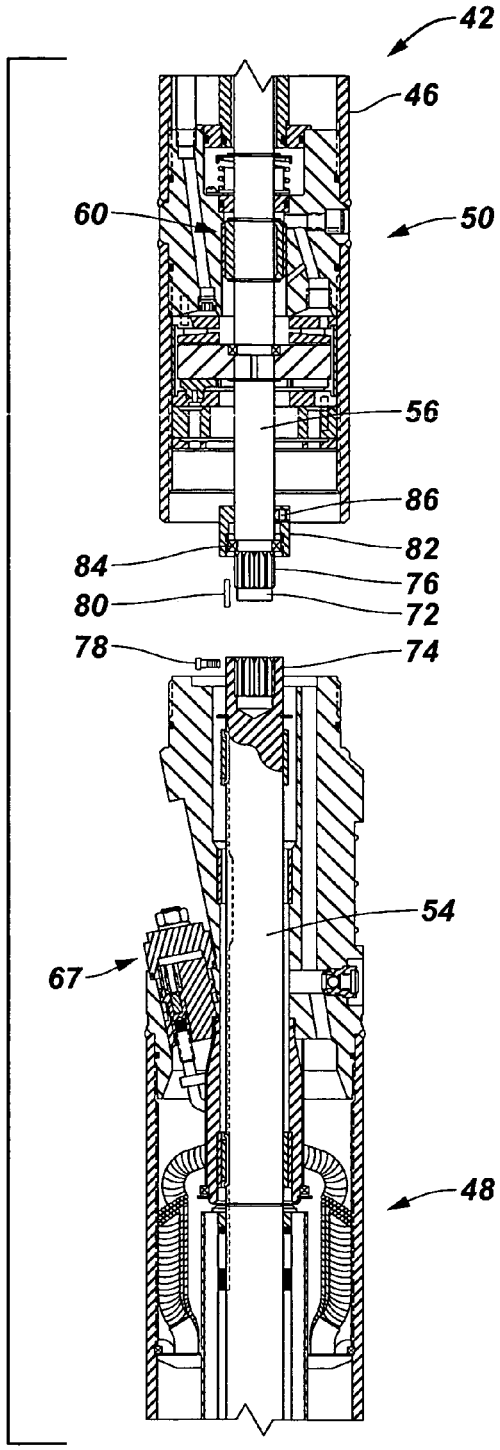
FIG. 3 is a cross-sectional view of another embodiment of the motor section and the protector section illustrated in FIG. 2.

Referring to FIG. 3, another embodiment of combined shaft sections 54 and 56 is illustrated. In this embodiment, the shaft sections are axially affixed to each other at a factory location, but the shaft sections potentially are separable to facilitate manufacture and servicing of the motive unit 42. The shaft sections 54 and 56 are joined, at a factory location, by a threaded joint. In this embodiment, an end 72 of one shaft section is inserted into a socket 74 of the axially adjacent section. Torque may be transmitted by a variety of mechanisms, such as integral splines 76, one or more cross bolts 78 (shown in phantom), one or more keys 80 (shown in phantom) or threads in the sleeve joint. The weight of motor shaft section 54 and attached rotor may be supported by, for example, cross bolts 78, threads in the second joint or a threaded collar 82. Threaded collar 82 hangs on a shoulder or retaining ring 84 affixed to shaft section 56. A set screw 86 can be used to prevent threaded collar 82 from backing off once threaded onto the end of shaft section 54.

Figure 4:
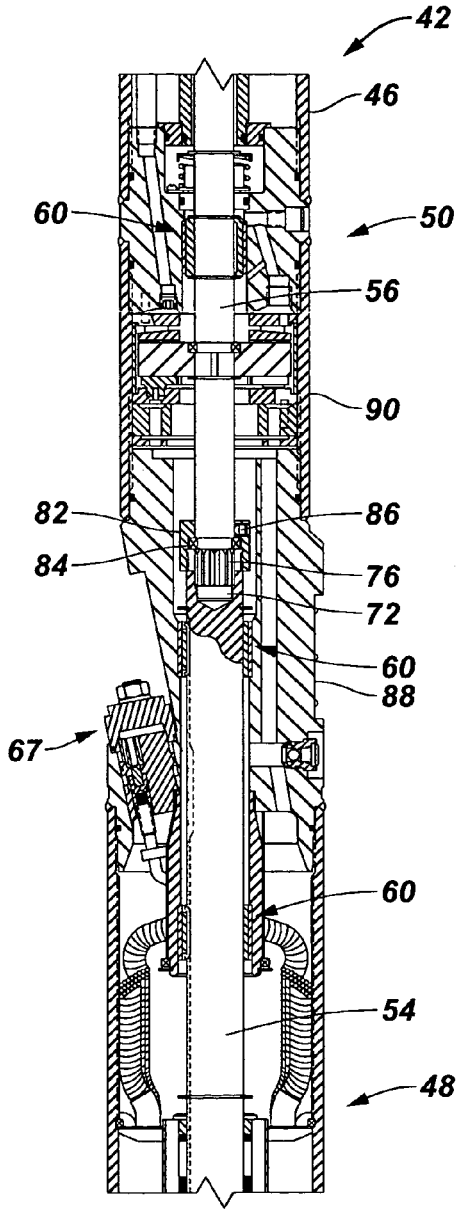
FIG. 4 is another illustration of the system illustrated in FIG. 3 but after construction of the motive unit has been completed.

As illustrated in FIGS. 3 and 4, once shaft sections 54 and 56 are axially affixed to each other, a portion 88 of outer housing 46 can be moved over the joint to enclose the joint. The outer housing 46 can then be completed by, for example, threadably engaging portion 88 (of the outer housing that encloses motor section 48) with a portion 90 (of the outer housing 46 that encloses protector section 50), as illustrated in FIG. 4.

Figure 5:
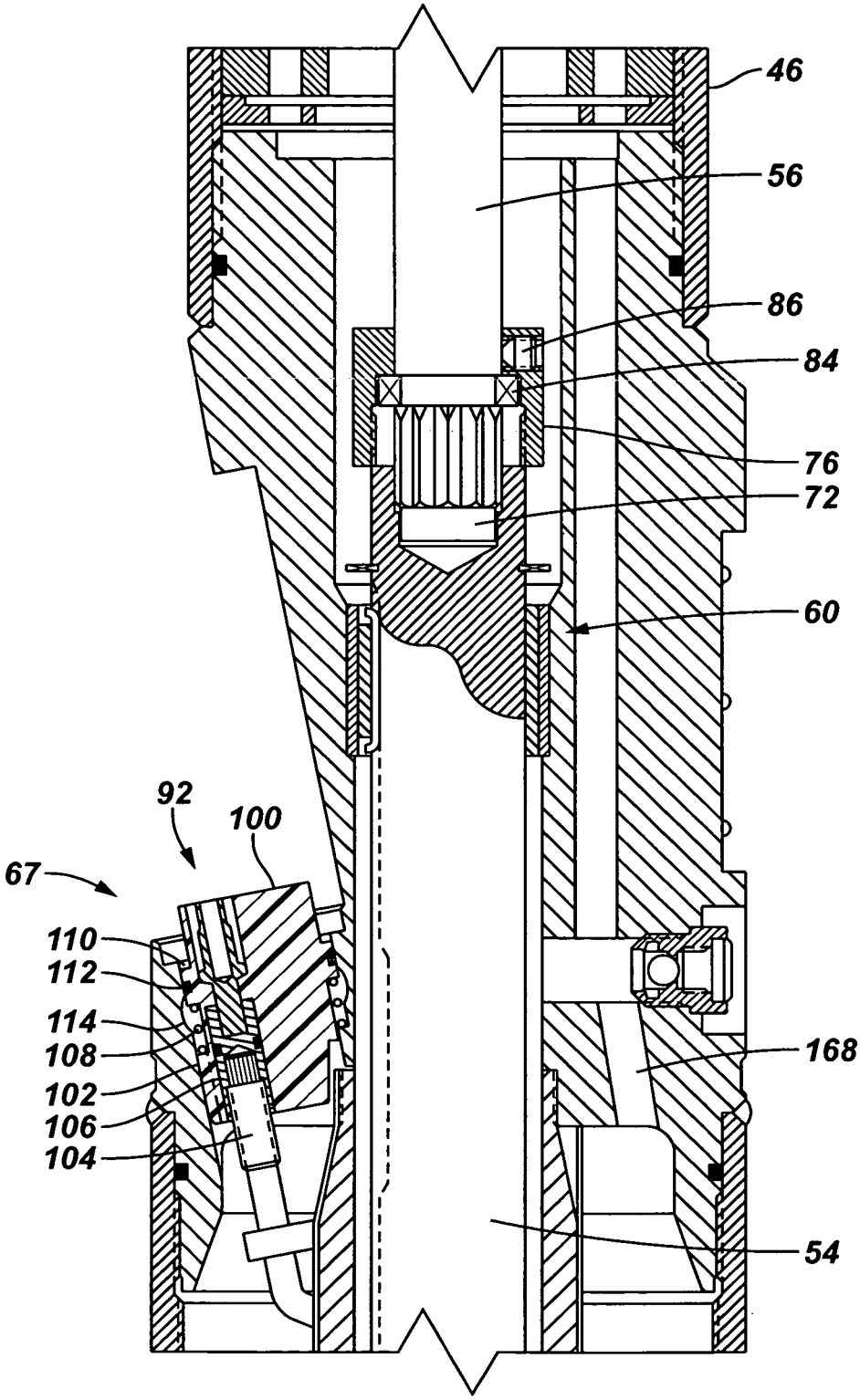
FIG. 5 is a cross-sectional view of a cable connector in a sealed position, according to an embodiment of the present invention.
Figure 6:
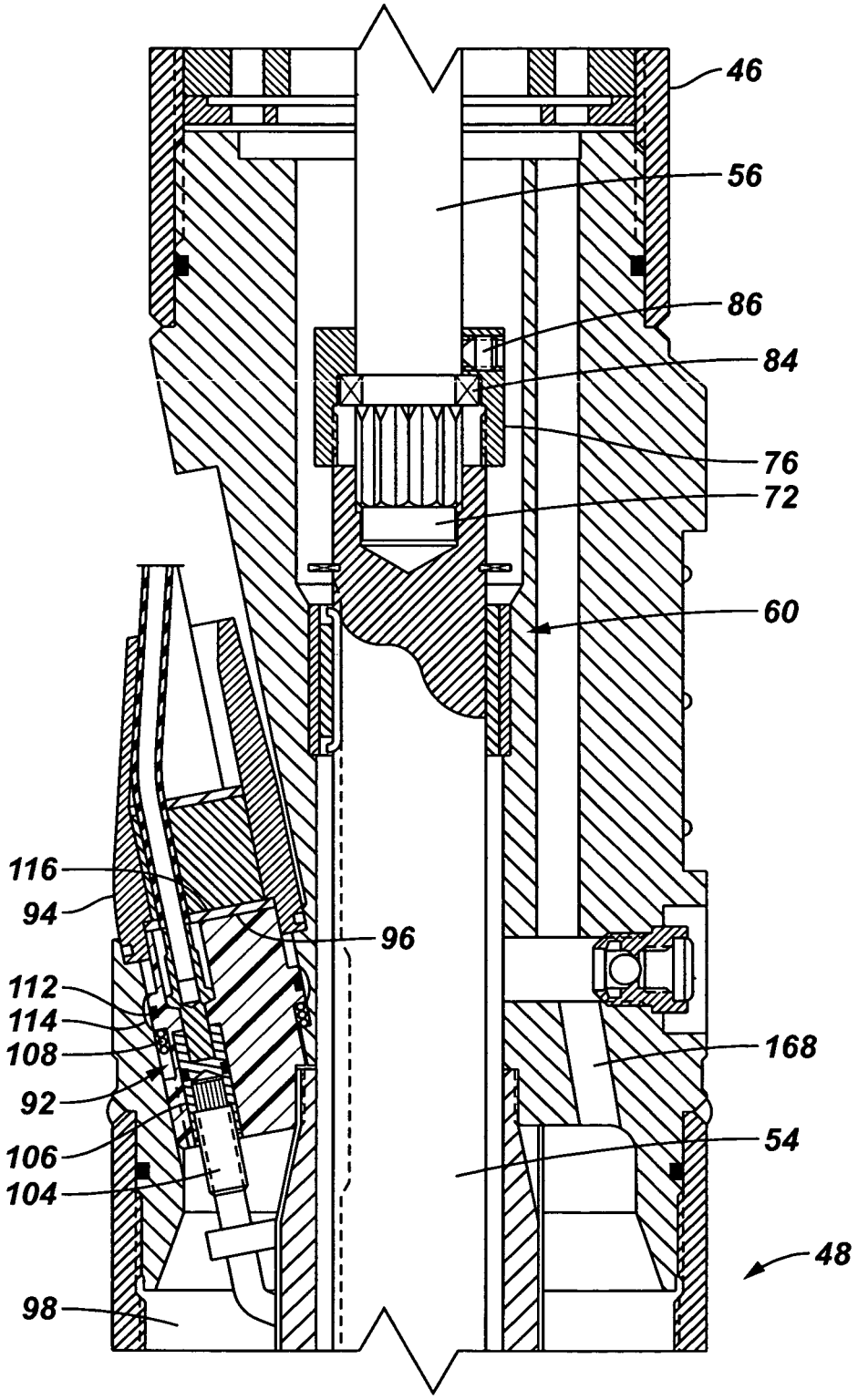
FIG. 6 is a view similar to FIG. 5 but showing the cable connection in an unsealed position.

To further prevent the loss of motor oil between prefilling at the factory and installation of the electric submersible pumping system into wellbore 24, electrical cable connection 67 may comprise a fluid loss prevention system 92, as illustrated in FIGS. 5 and 6. It should be noted that fluid loss prevention system 92 can be utilized with a variety of submersible motors and motive units and is not limited to use with the embodiments described herein. System 92 prevents loss of motor oil between the time the shipping cap is removed from electric cable connection 67 and the time a cable connector 94 (see FIG. 6) is plugged into cable connection 67. Once cable connector 94 is plugged into cable connection 67, fluid communication is established between a connection interface 96 and an interior volume 98 of motor section 48, which is pressure balanced with wellbore 24. Thus, electric cable connection 67 is transitioned between a closed or sealed position, as illustrated best in FIG. 5, and an open position, as illustrated best in FIG. 6. The cable connection 67 prevents high differential pressure from damaging the connection through well fluid entry or through excessive force. Cable connection 67 also ensures that any small leaks of well fluid into the electrical cable connection are diluted and disbursed within the motor. Instead of being concentrated in electric cable connection 67 where it would be more likely to cause an electrical fault, the open position of connection 67 allows any small, intruding amount of well fluid to progress into interior volume 98.

In FIG. 5, fluid loss prevention system 92 is illustrated as having a spring loaded terminal block 100. The terminal block 100 acts as a valve poppet and is biased to the sealed position. In this embodiment, terminal block 100 is slidably mounted in a terminal port 102 where motor leads 104 extend into conductive contact with a conductive element 106 of terminal block 100. A spring member 108 biases terminal block 100 toward a retaining ring 110 and the sealed position. A seal 112, such as an O-ring seal, is disposed between terminal block 100 and an inner surface of terminal port 102 to seal electric cable connection 67 against the influx of unwanted fluid. When terminal block 100 is moved against spring member 108 and toward the open position illustrated in FIG. 6, seal 112 is moved over a relief groove 114 formed in the inner wall of terminal port 102. Movement of terminal block 100 against the spring bias of spring member 108 can be accomplished, for example, by plugging cable connector 94 into electric cable connection 67, as illustrated in FIG. 6. In this embodiment, spring member 108 also compresses a dielectric gasket 116 between the adjacent faces of cable connector 94 and terminal block 100 along connection interface 96. The dielectric gasket 116 limits undesirable electrical tracking.

Figure 7:
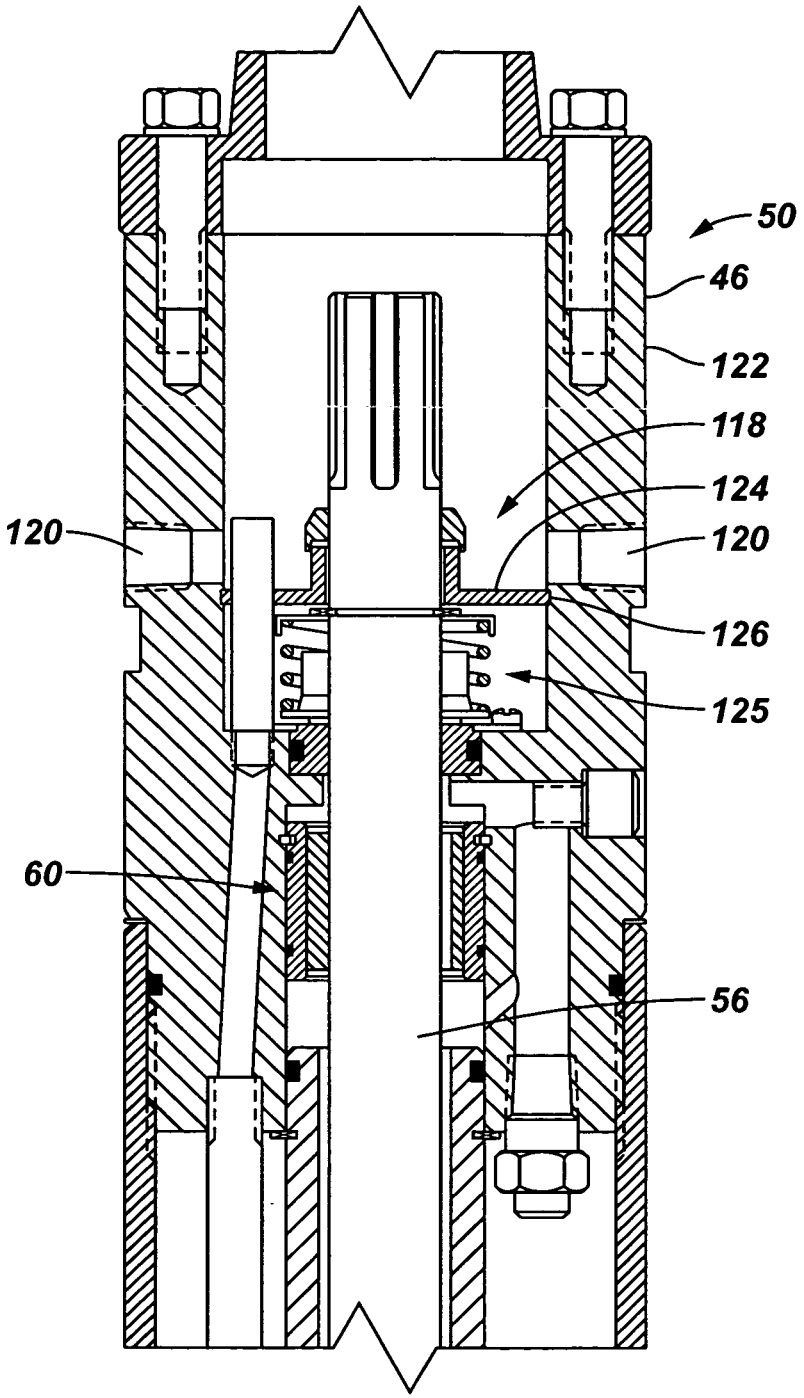
FIG. 7 is a cross-sectional view of a head of the protector section illustrated in FIG. 2.

Referring now to FIG. 7, motive unit 42 also may incorporate a protection mechanism 118 that reduces the potential for sand to damage motive unit 42. This particular feature also can be adapted to other types of motor protectors and downhole components. As illustrated, protection mechanism 118 comprises one or more sand escape holes 120 that are formed laterally through outer housing 46 at a head 122 of motor protector section 50. Sand escape holes 120 enable the flushing of sand from protector section 50 by well fluid before the sand can damage journal bearings 60 or other internal components of motive unit 42. Protection mechanism 118 also may comprise a shroud 124 positioned over the upper or head bearing 60 to block sand from moving downwardly to the head journal bearing or other internal components. A rotating shaft seal 125 may be positioned between the shroud 124 and the head bearing 60. Furthermore, shroud 124 may be received and held in place by a groove 126 formed along the inside diameter of outer housing 46. Although shroud 124 can be made from a variety of materials, the illustrated shroud is formed from a polymeric material, such as a hard rubber. Additionally or alternatively, the head bearing 60 can be made from a ceramic or carbide material to resist abrasives from the well fluid and to resist wear due to vibration resulting from operation of submersible pump 36.

Figure 8:
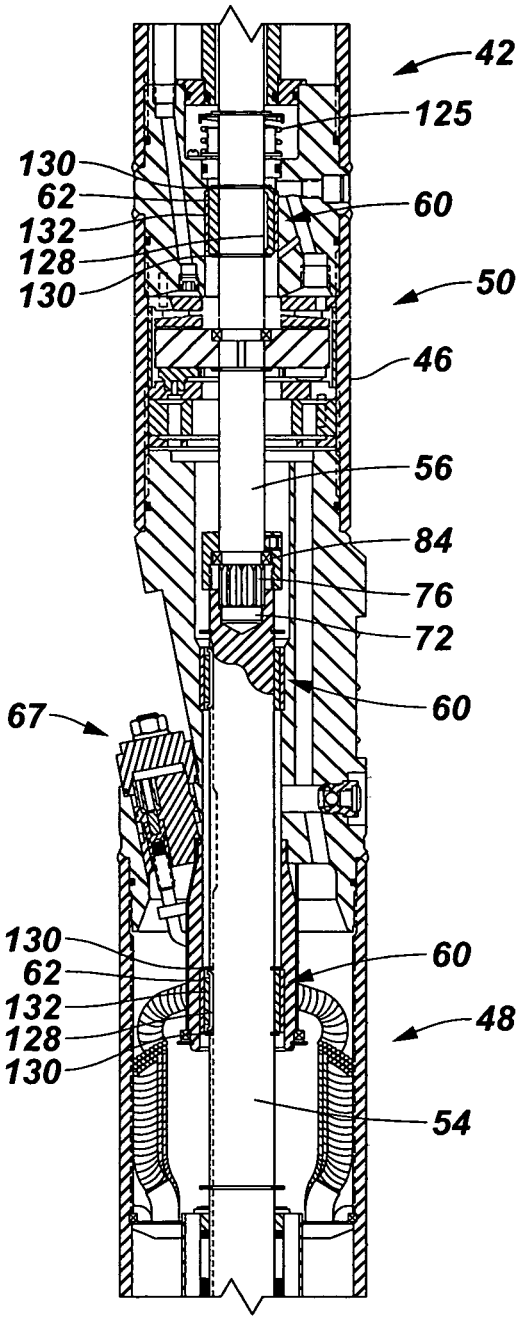
FIG. 8 is a cross-sectional view of a journal bearing system illustrated in FIG. 2.
Figure 9:
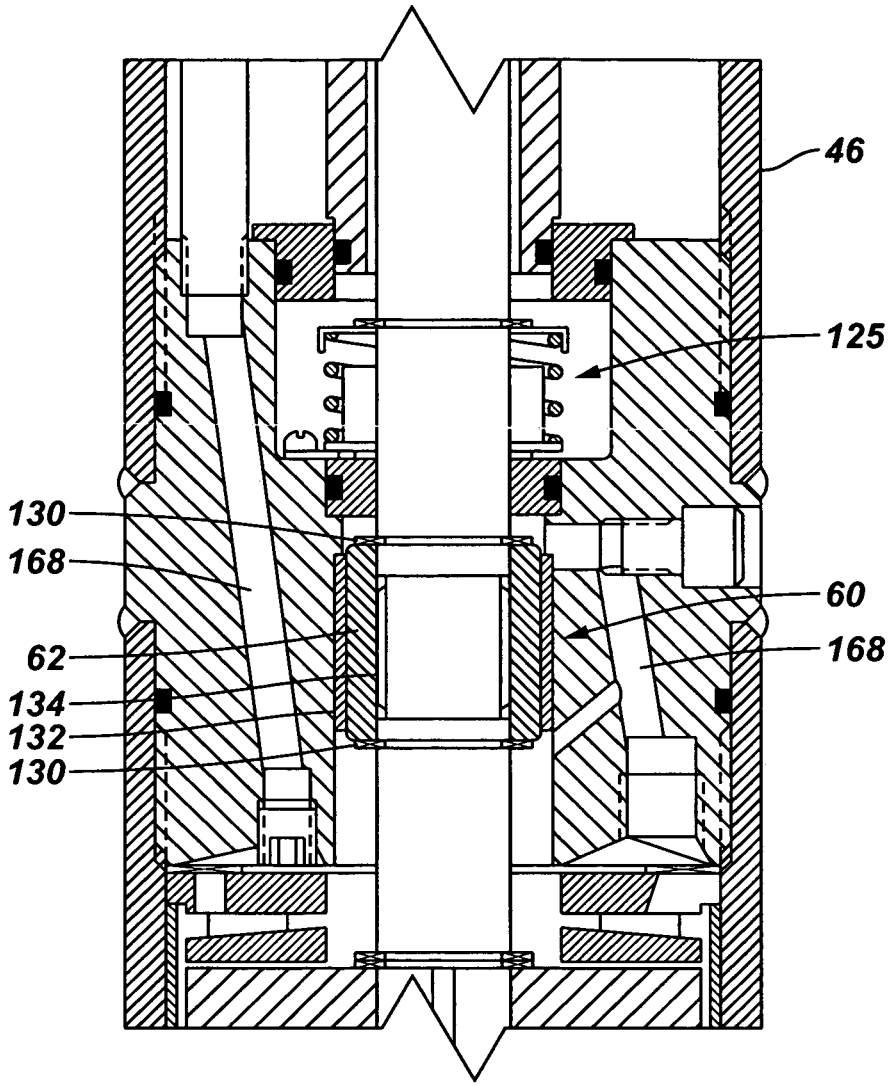
FIG. 9 is an alternate embodiment of the journal bearing system illustrated in FIG. 8.
Figure 10:
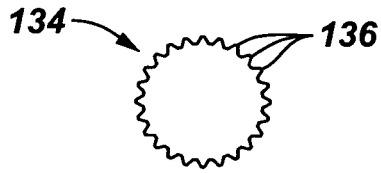
FIG. 10 is an end of view of a tolerance ring illustrated in FIG. 9.

In the embodiments illustrated in FIGS. 8, 9 and 10, journal bearings 60 utilize wear sleeves 62 that are replaceable. Thus, new wear sleeves 62 can be installed in motive unit 42 to prolong the usable life of the unit. With specific reference to FIG. 8, each wear sleeve 62 is removably coupled to either shaft section 54 or shaft section 56 by a key 128 and a pair of snap rings 130. Key 128 prevents rotational movement of the wear sleeve 62 about the shaft section, and snap rings 130 limit axial movement of the wear sleeve 62 along the shaft section. Additionally, each radial bearing 60 may comprise a self lubricating bushing 132. Bushings 132 can be used throughout motive unit 42, including within the rotor bearings of motor section 48, to reduce bearing wear under conditions of poor lubrication and oil deterioration. A self lubricating bushing 132 can be designed to run against hard metal journals. Examples of suitable bushing materials include polymer coated sheet metal bushings, such as Glacier HieX® or DP4® polymer coated sheet metal bushings.

An alternate embodiment of journal bearings 60 and replaceable wear sleeves 62 is illustrated in FIGS. 9 and 10. In this embodiment, each wear sleeve 62 is placed onto a shaft section 54 or 56 using a tolerance ring 134. The tolerance ring 134 enables a replaceable wear sleeve 62 to be press fit over the shaft at a location remote from the shaft ends without the need for press fitting the wear sleeve 62 along the entire shaft distance between the shaft end and the desired bearing location. As illustrated best in FIG. 10, each tolerance ring 134 may be formed as a thin sleeve having corrugations 136 that enable creation of a press fit between two cylindrical parts.

Figure 11:
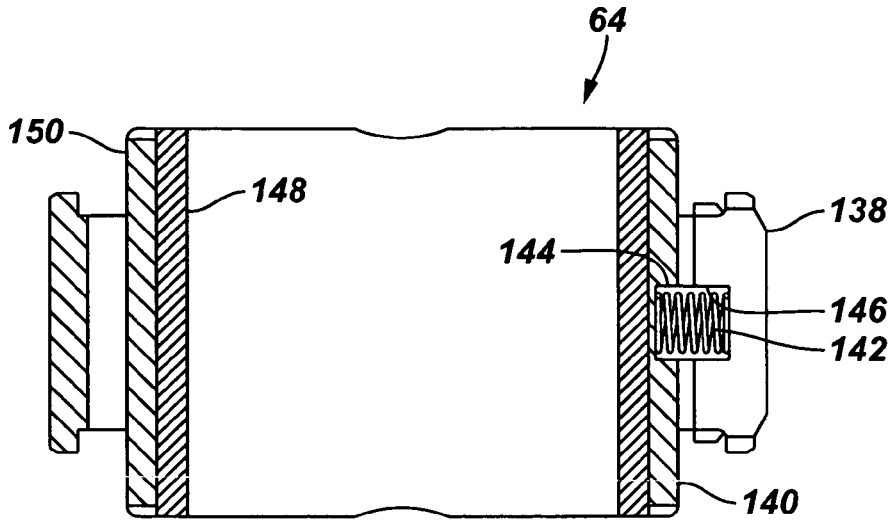
FIG. 11 is a cross-sectional view of a rotor bearing system illustrated in FIG. 2.
Figure 12:
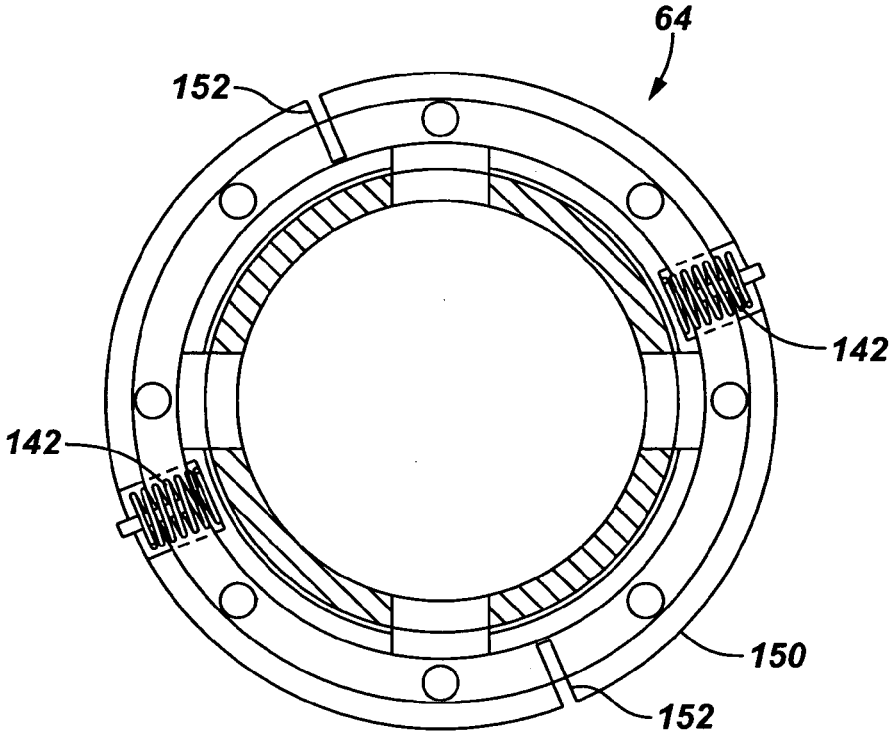
FIG. 12 is an end view of the rotor bearing system illustrated in FIG. 11.

The motive unit 42 also comprises one or more rotor bearings 64 that are rotationally held in place to prevent spinning of the bearing with motor shaft section 54. In this embodiment, as illustrated in FIGS. 11 and 12, each rotor bearing 64 comprises a spring loaded key 138 disposed along an outer surface 140 of the rotor bearing 64. The spring loaded key 138 is biased in a radially outward direction for engagement with a surrounding structure, such as the inner surface of stator laminations within motor section 48. The key 138 is biased outwardly by a spring 142 compressed between a recess 144 formed through outer surface 140 and a recess 146 formed in an interior of key 138. Rotor bearing 64 also may comprise a self lubricating bushing 148 positioned along a radially inward side of the bearing, i.e. along shaft section 54.

As illustrated in FIG. 12, the self lubricating bushing 148 can be designed for an interference fit when placing the self lubricating bushing within the surrounding bearing body 150. A problem with such interference fits is that when a bushing is pressed into a bearing body having a keyway, the bearing distorts out of round because the keyway reduces the stiffness of the bearing at that location relative to the remaining unkeyed section. Accordingly, additional keyways or slots 152 are added to bearing body 150 to equalize the distortion and maintain roundness within desired tolerances. For example, slots 152 may be positioned in cooperation with existing keyways to form breaks at equally spaced positions around the bearing body.

Figure 13:
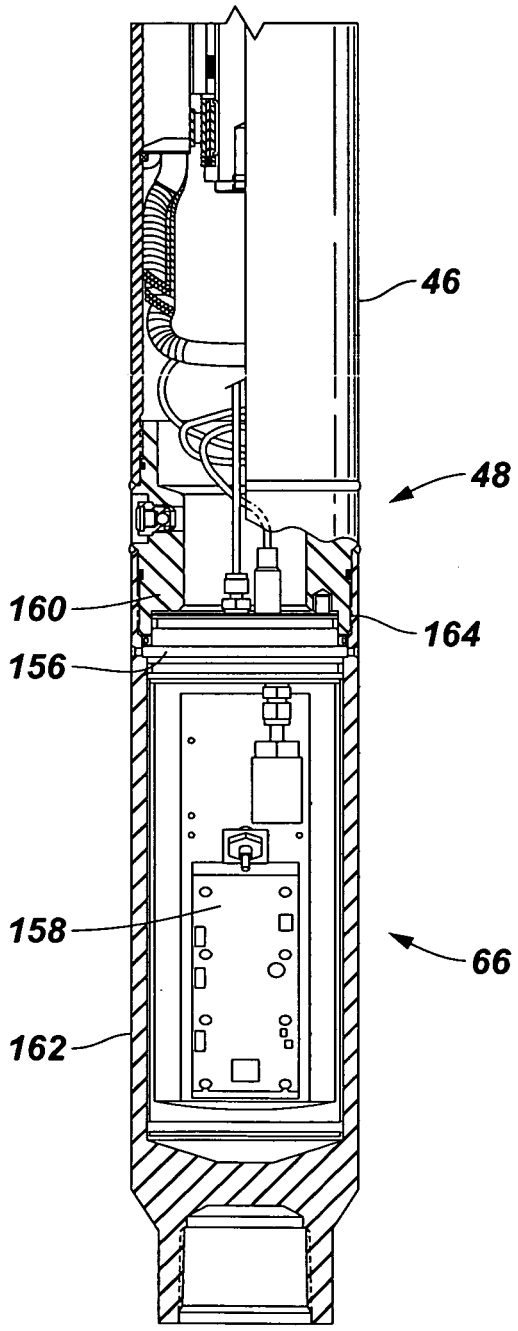
FIG. 13 is an elevation view of an embodiment of the motor section with an integral sensor to measure a wellbore parameter, according to an embodiment of the present invention.
Figure 14:
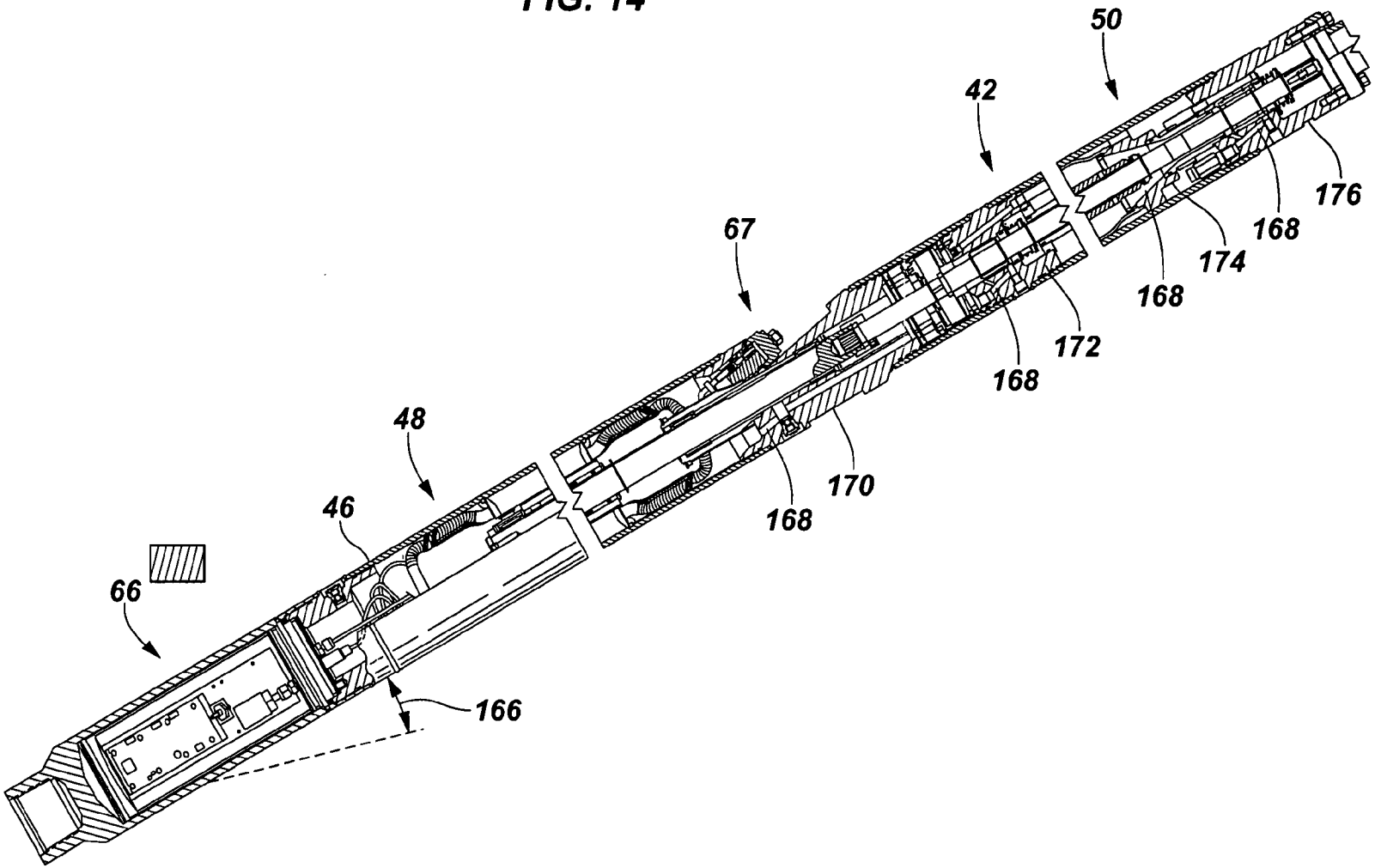
FIG. 14 is an illustration of the motive unit positioned at an angle to facilitate filling of the unit with internal motor fluid.

As illustrated in FIG. 13, motor section 48 also may comprise sensor 66 for sensing at least one well related parameter, such as temperature, pressure, vibration and/or flow rate. Sensor 66 may be a multi-sensor designed to sense multiple parameters. In this embodiment, sensor 66 is filled with atmospheric pressure air and isolated from the motor oil and well pressure by, for example, a non-threaded bulkhead 156 to which sensor electrical and gauge components 158 are attached. Bulkhead 156 is designed for assembly into motor section 48 without rotating to avoid twisting of any wiring. Also, bulkhead 156 is positioned between a motor base 160 and an external sensor housing 162. Housing 162 is not attached to sensor components 158 but passes over the exterior of bulkhead 156 for attachment to the next adjacent section of outer housing 46 by, for example, a threaded connection 164.

As discussed above, the design of motive unit 42 as a single device with motor section and protective section combined enables pre-filling of the unit with internal fluid without concern for later loss of fluid. Due to the potential height of motive unit 42, such pre-filling of the motive unit can be facilitated by filling the unit when disposed at an angle. For example, the motive unit may be positioned at an angle, denoted by reference numeral 166, of less then 45 degrees from horizontal. Accordingly, a plurality of oil communication holes 168 also are disposed at an angle with respect to axis 58 to better vent bubbles as the motive unit 42 is filled with oil. The oil communication holes may be formed at an angle through a variety of motive unit structures, including, for example, a motor head 170, a seal body 172, a bag frame 174 and a protector head 176. The angle of the oil communication holes can be selected to generally correspond to a desired angle 166, thereby facilitating release of bubbles.

Accumulated gas can create problems if allowed to accumulate proximate internal components, such as shaft seals, bearings, breathing regions of protector chambers or other susceptible components. Bubbles trapped at rotating components, such a shaft seals and bearings, can cause damage by excluding oil lubrication. Additionally, bubbles trapped in the breathing region of a protector chamber can be drawn down into rotating components below the chamber when the motor section is shut down. The damage typically results upon restarting the motor section or motive unit 42.

Accumulation of gas can occur for a variety of reasons. For example, the accumulation can occur as a result of air remaining in the unit due to incomplete filling with lubricating oil; air entrained in the lubricating oil during filling; release of gases dissolved in the lubricating oil upon temperature increase or pressure decrease; dissolved wellbore gases that are released upon temperature increase or pressure decrease; or gases created by chemical reactions in the equipment. If such gases build up around susceptible components during operation, the electric submersible pumping system 22 may require premature servicing or replacement.

Figure 15:
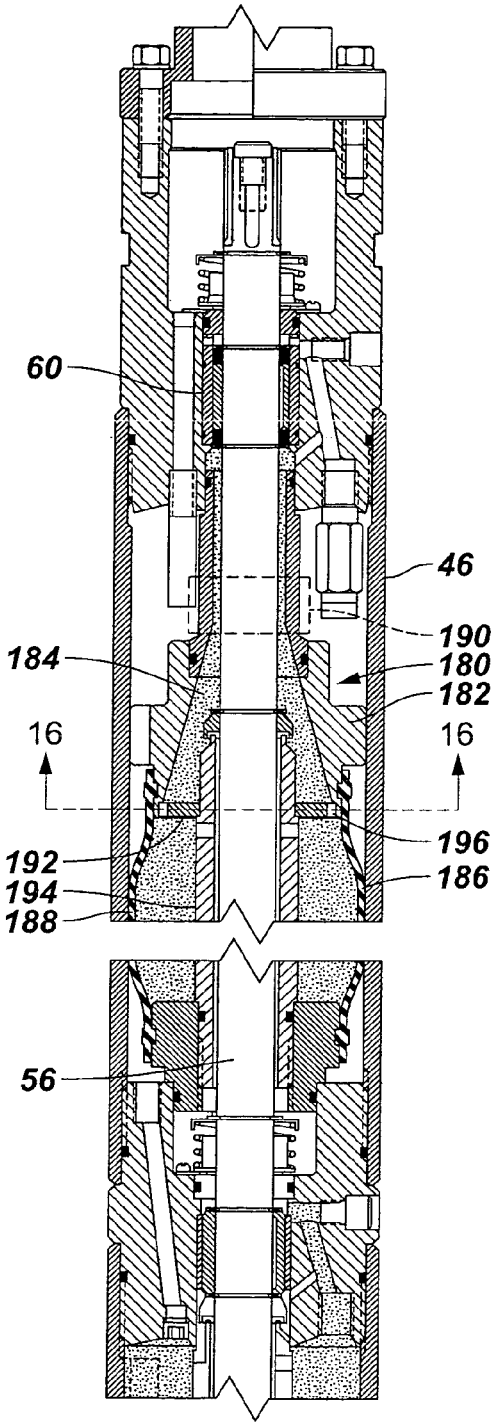
FIG. 15 is a cross-sectional view of a bubble sump taken generally along an axis of the unit, according to an embodiment of the present invention.
Figure 16:
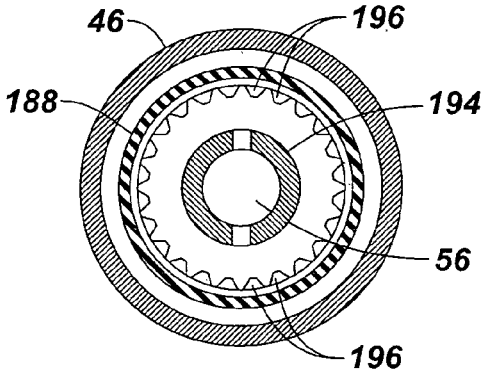
FIG. 16 is a cross-sectional view taken generally along line 16-16 of FIG. 15.

As illustrated in FIGS. 15 and 16, a bubble sump 180 is disposed within outer housing 46. The bubble sump 180 utilizes a framework 182 that creates a dedicated volume 184 disposed within. The dedicated volume 184 is of sufficient size to collect gas that could otherwise interfere with the operation of internal components during normal operation of electric submersible pumping system 22.

In the embodiment illustrated, bubble sump 180 is disposed above a component 186 that is to be protected from an accumulated gas. Component 186 can comprise a variety of components. For example, component 186 may be a rotating component, such as a shaft seal or bearing 60. In such embodiment, the dedicated volume 184 is provided above the rotating component, and framework 182 can, for example, be formed from the same housing that houses the rotating component. In another embodiment, component 186 can comprise a labyrinth chamber, and the dedicated volume 184 is disposed above, for example, a standing tube of the labyrinth chamber. The dedicated volume 184 serves as a bubble sump for collecting bubbles that otherwise could be sucked down into a thrust bearing chamber or a motor head and cause damage to the rotating components. In another example, component 186 can comprise a bag chamber, and the dedicated volume 184 is disposed above the bag chamber. For example, a protector bag 188 and bag chamber is illustrated in FIG. 15. In this embodiment, the dedicated volume 184 of bubble sump 180 serves to prevent bubbles from being sucked downwardly through the protector section.

A valve system 190 also can be incorporated into bubble sump 180 to vent accumulated bubbles from the bubble sump without losing motor oil and without admitting fluid from the wellbore. Valve system 190 is illustrated by dashed lines in FIG. 15. Valve system 190 may be constructed in a variety of forms depending on the specific application. For example, the system may comprise a float actuated valve and a relief valve that vent bubbles to the wellbore when the pressure in the bubble sump exceeds the pressure from the wellbore by a safe margin. In another embodiment, valve system 190 may employ a phase sensor and/or a pressure transducer to determine appropriate times for venting gas.

With additional reference to FIG. 16, the illustrated embodiment of bubble sump 180 shows the bubble sump disposed about a shaft, such as shaft section 54 or shaft section 56. In this embodiment, framework 182 further comprises a base plate 192 through which the shaft and a surrounding shaft tube 194 extend. Base plate 192 comprises a plurality of vent holes 196 through which bubbles of gas pass from component 186 into dedicated volume 184 were the gas is maintained remotely from components that otherwise could be damaged. The bubble sump system can be incorporated into a variety of submersible units, such as submersible motors, submersible motor protectors, or combined components, such as motive unit 42.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for producing oil, comprising:

a submersible pump; and a motive unit to power the submersible pump, the motive unit being a single device with a motor section and motor protector section to seal the motor section from surrounding fluid and to accommodate thermal expansion of an internal lubricating fluid during production of oil, the motive unit comprising a plurality of bearings, the motor section comprising a motor section shaft and the motor protector section comprising a motor protector section shaft, at least one of the motor section shaft and the motor protector section shaft extending longitudinally from an outer housing so the motor section shaft and the motor protector section shaft become axially affixed to each other with respect to a longitudinal axis of the motive unit to form a joint which is axially locked against separation that would otherwise occur due to the weight of the motor section, wherein the outer housing is longitudinally movable with respect to the joint such that after axially affixing the motor section shaft and the motor protector section shaft the outer housing is moved longitudinally to enclose the joint once the joint is axially locked.

2. The system as recited in claim 1, wherein the motor section shaft and the motor protector section shaft are affixed to each other by a threaded joint.

3. The system as recited in claim 1, wherein the motor section shaft and the motor protector section shaft are affixed to each other by an interference fit.

4. The system as recited in claim 1, wherein the motor section shaft and the motor protector section shaft are affixed to each other by a cross bolt.

5. The system as recited in claim 1, wherein the motive unit comprises an electrical cable connection having a spring biased terminal block movable between a sealed position and an open position.

6. The system as recited in claim 1, wherein the motor section shaft and the motor protector section shaft are affixed with integral splines to transmit torque.

7. The system as recited in claim 1, wherein the motor section shaft and the motor protector section shaft are affixed with axial threads to support weight.

8. The system as recited in claim 1, wherein the motor section shaft and the motor protector section shaft are affixed with a threaded collar to support weight.

9. The system as recited in claim 1, wherein the motive unit comprises at least one journal bearing having a replaceable sleeve.

10. The system as recited in claim 1, wherein the motor section comprises a rotor bearing having a spring-loaded key.

11. The system as recited in claim 1, wherein the motor section comprises an integral sensor to sense at least one well related parameter.

12. The system as recited in claim 1, wherein the motive unit has an axis and a plurality of oil communication holes deployed at an angle with respect to the axis to purge air at a specified angle between vertical and horizontal at which the system is filled with oil.

13. A method of forming a motive unit for a submersible pumping system, comprising:

connecting a motor section shaft to a protector section shaft to form an axially affixed connection;

after connecting the motor section shaft to the protector section shaft, moving a housing of a motor section or a protector section longitudinally relative to a corresponding housing of the other of the motor section or the protector section and relative to the axially affixed connection to enclose the axially affixed connection and to form a combined motor section and protector section; and prefilling the combined motor section and protector section with a lubricating fluid prior to delivery of the combined motor section and protector section to a wellbore location.

14. The method as recited in claim 13, further comprising moving the combined motor section and protector section to a desired wellbore location.

15. The method as recited in claim 13, wherein connecting comprises utilizing a threaded coupler.

16. The method as recited in claim 13, further comprising threadably engaging the housing of the motor section with the housing of the protector section.

17. The method as recited in claim 13, further comprising providing the motor section with a terminal block that is spring biased toward a sealed position, the terminal block being movable to an open position upon pluggably receiving a cable connector.

18. The method as recited in claim 13, further comprising providing the combined motor section and protector section with a journal bearing having a replaceable wear sleeve.

19. The method as recited in claim 13, further comprising utilizing a bearing with a self lubricating bushing.

20. The method as recited in claim 13, further comprising incorporating an integral sensor into the motor section.

21. The method as recited in claim 13, further comprising forming oil communication holes at a nonzero degree angle with respect to an axis of the combined motor section and protector section.

22. A system for producing a fluid, comprising:

a motor section having an electrical cable connection, the electrical cable connection having a terminal block acting as a valve poppet and movable between a sealed position and an open position that enables fluid communication between a connection interface and an interior volume of the motor section, the electrical cable connection further comprising an O-ring seal disposed between the terminal block and an inner surface of a terminal port and a spring to spring bias the terminal block toward the sealed position, wherein when the terminal block is moved against the spring member and toward an open position, the O-ring seal is moved over a relief groove formed in the inner surface of the terminal port.

23. The system as recited in claim 22, further comprising a dielectric gasket to limit electrical tracking.

* * * * *